US006709246B2

(12) United States Patent
Boyd

(10) Patent No.: US 6,709,246 B2
(45) Date of Patent: Mar. 23, 2004

(54) INFLATION/DEFLATION DEVICE HAVING SPRING BIASED VALUE

(75) Inventor: Dennis Boyd, Chesterfield, MO (US)

(73) Assignee: Boyd Flotation, Inc., St. Louis, MO (US)

( * ) Notice: Subject to any disclaimer, the term of this patent is extended or adjusted under 35 U.S.C. 154(b) by 0 days.

(21) Appl. No.: 10/140,099

(22) Filed: May 7, 2002

(65) Prior Publication Data

US 2003/0210994 A1 Nov. 13, 2003

(51) Int. Cl.[7] ..... F04B 35/04

(52) U.S. Cl. ..... 417/423.1; 417/440; 139/596.17; 5/708; 5/713; 601/148; 601/6; 601/9

(58) Field of Search ..... 417/32, 423.1, 417/440, 307, 326, 280; 139/596.17; 5/706, 708, 710, 713; 601/148–152, 6, 9

(56) References Cited

U.S. PATENT DOCUMENTS

| | | | | |
|---|---|---|---|---|
| 4,390,324 A | * | 6/1983 | Karliner | 417/282 |
| 4,559,971 A | * | 12/1985 | Bradshaw | 137/596.17 |
| 4,678,014 A | * | 7/1987 | Owen et al. | 141/67 |
| 4,829,616 A | | 5/1989 | Walker | 5/453 |
| 4,897,890 A | | 2/1990 | Walker | 5/453 |
| 4,977,633 A | | 12/1990 | Chaffee | 5/453 |
| 5,267,363 A | | 12/1993 | Chaffee | 5/453 |
| 5,368,446 A | * | 11/1994 | Rode | 417/18 |
| 5,509,154 A | * | 4/1996 | Shafer et al. | 5/713 |
| 5,890,882 A | | 4/1999 | Feldman | 417/411 |
| 5,904,172 A | | 5/1999 | Gifft et al. | 137/224 |
| 6,332,760 B1 | * | 12/2001 | Chung | 417/411 |

OTHER PUBLICATIONS www.bittersweetgear.com, Coleman 12 Volt Quickpump, Dec. 31, 1988, www.bittersweetgear.com, p. 1 of 1.*
www.bittersweetgear.com, Coleman 12 Volt Quickpump, Dec. 31, 1988, www.bittersweetgear.com, p. 1 of 1.*
www.bittersweetgear.com, Coleman 12 Volt Quickpump, Dec. 31, 1988, www.bittersweetgear.com, p. 1 of 1.*
U.S. patent application Publication No. US 2001/0044969 A1, Publ. Date Nov. 29, 2001, Title: Inflatable Device With Recessed Fluid Controller and Modified Adjustment Device, Inventor Chaffee; Appln. No. 09/859,706, Filed on May 17, 2001.

* cited by examiner

*Primary Examiner*—Justine R. Yu
*Assistant Examiner*—Emmanuel Sayoc
(74) *Attorney, Agent, or Firm*—Thompson Coburn LLP; Caroline G. Chicoine

(57) ABSTRACT

The invention is drawn to an apparatus for supplying fluid, such as air, under pressure to a fluid accommodating means such as an air mattress and automatically adjusting the fluid pressure. The apparatus has a coupling device which attaches the apparatus to the air mattress. A housing encloses a motor, an impeller, a two-way valve and a solenoid. The solenoid opens the two-way valve to allow inflation or deflation of the air mattress. The motor is reversible and the impeller is used to force fluid into or out of the mattress. A controller is used to inflate and deflate the mattress. The controller can be attached to the apparatus or it can be a remote control.

25 Claims, 5 Drawing Sheets

INFLATION/DEFLATION DEVICE HAVING SPRING BIASED VALUE

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

The invention relates to fluid pumps and controls having valves and switches associated with the pumps for regulating fluid pressure in one or more fluid accommodating structures. More particularly, the invention is directed to air pumps and hand controls for supplying air under pressure to air mattresses and adjusting the pressure of the air in the air mattresses.

2. Related Art

Air beds use air mattresses to provide yieldable body support. The air mattresses are often inflated with pumps, such as hand operated pumps and bag pumps. Motor driven blowers and pumps have also been used to supply air under pressure to air mattresses. The biasing or firmness characteristic of an air mattress is determined by the pressure of the air in the air mattress. The air mattress firmness can be varied by supplying additional air or venting air from the air mattress. Control mechanisms have been used to adjust the inflation of air mattresses. U.S. Pat. Nos. 4,829,616; 4,897,890; 5,509,154 and 5,267,363 disclose different types of inflation devices used with air mattresses.

SUMMARY OF THE INVENTION

The invention is drawn to an apparatus for supplying fluid, such as air, under pressure to an air mattress and automatically adjusting the fluid pressure. The apparatus has a coupling device which attaches the apparatus to the air mattress. A housing encloses a motor, an impeller, a two-way valve and a solenoid. The solenoid opens the two-way valve to allow inflation or deflation of the air mattress. The motor is reversible and the impeller is used to force fluid into or out of the mattress. A controller is used to inflate and deflate the mattress. The controller can be attached to the apparatus or it can be a remote control.

A power source supplies the power necessary to operate the motor. The power source can be of any type including AC, DC, or battery. The two-way valve is similar to the valve disclosed in my U.S. patent application Ser. No. 09/909,794 filed on Jul. 20, 2001 (herein incorporated by reference). A display may be used to indicate the pressure in the air mattress as detected by an optional pressure transducer in the apparatus. The pressure transducer can accurately determine the pressure in the air mattress because the two-way valve seals the system. The invention may also include a pressure shut-off switch which is activated at a predetermined pressure. The pressure shut-off switch opens the circuit providing power to the solenoid and the motor. As a result the motor stops operating and the two-way valve is returned to its normally closed position by a biasing spring which pushes the actuator arm of the solenoid away.

In addition to the pressure shut-off switch, there may be a thermal shut-off switch attached to the motor. At a predetermined temperature the thermal shut-off switch is activated with the same results as the pressure shut-off switch.

The coupling device attaches to the air mattress in a number of manners. When the mattress has a threaded opening the coupling device attaches by screwing on to the threaded opening. A resilient o-ring is sandwiched between the opening and the coupling device providing a fluid tight seal. The device can also be used to inflate items without a threaded opening. Different diameter outlets can be selected depending on the application. In the event of a valved closure located on the mattress, the device utilizes an opener extending from the periphery of the outlet.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings:

FIG. 1(*b*) illustrates a cutaway view of the device in an open state;

DETAILED DESCRIPTION OF THE PREFERRED EMBODIMENTS

Figure 1A:
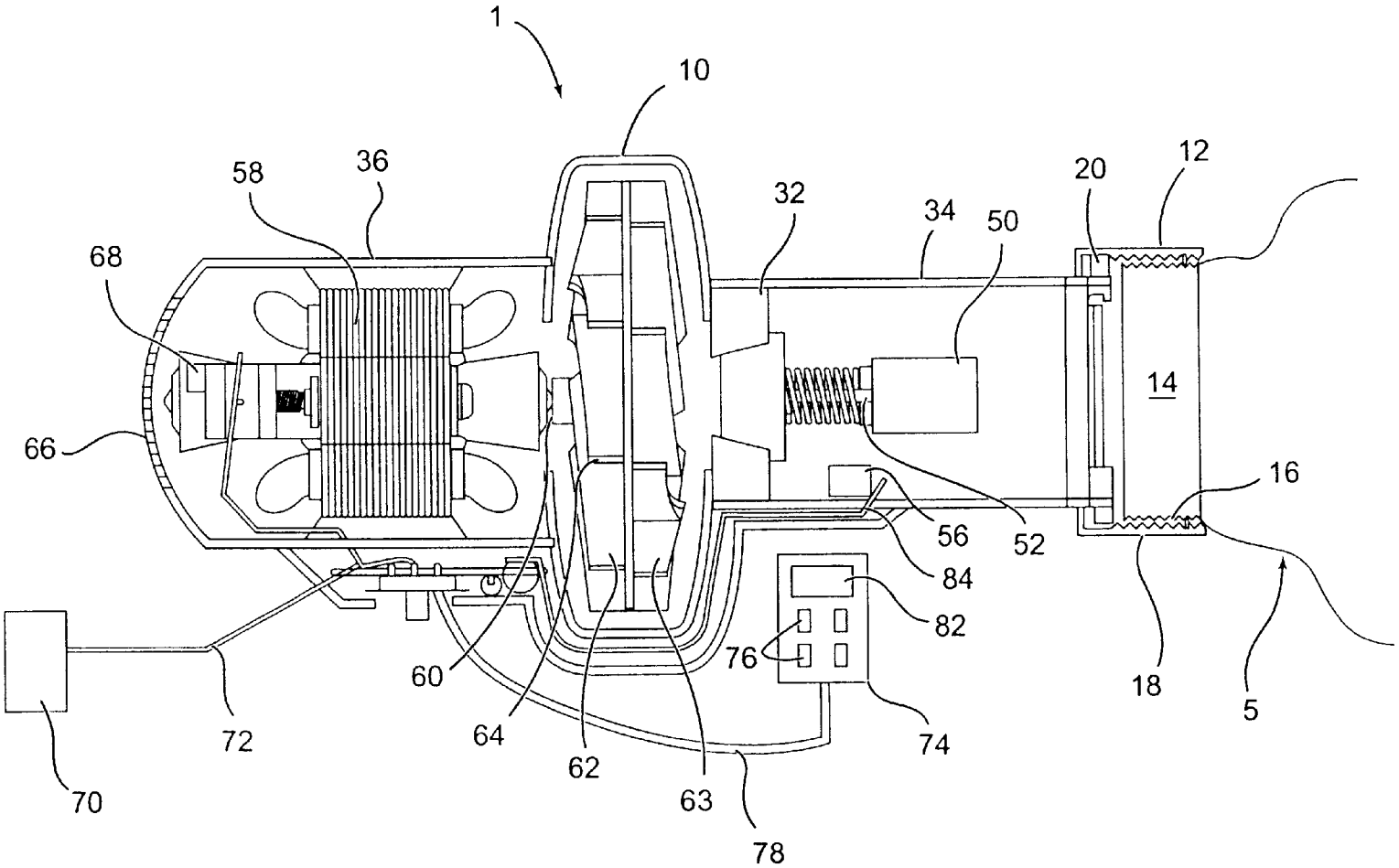
FIG. 1(*a*) illustrates a cutaway view of the device in a closed state.
Figure 1B:
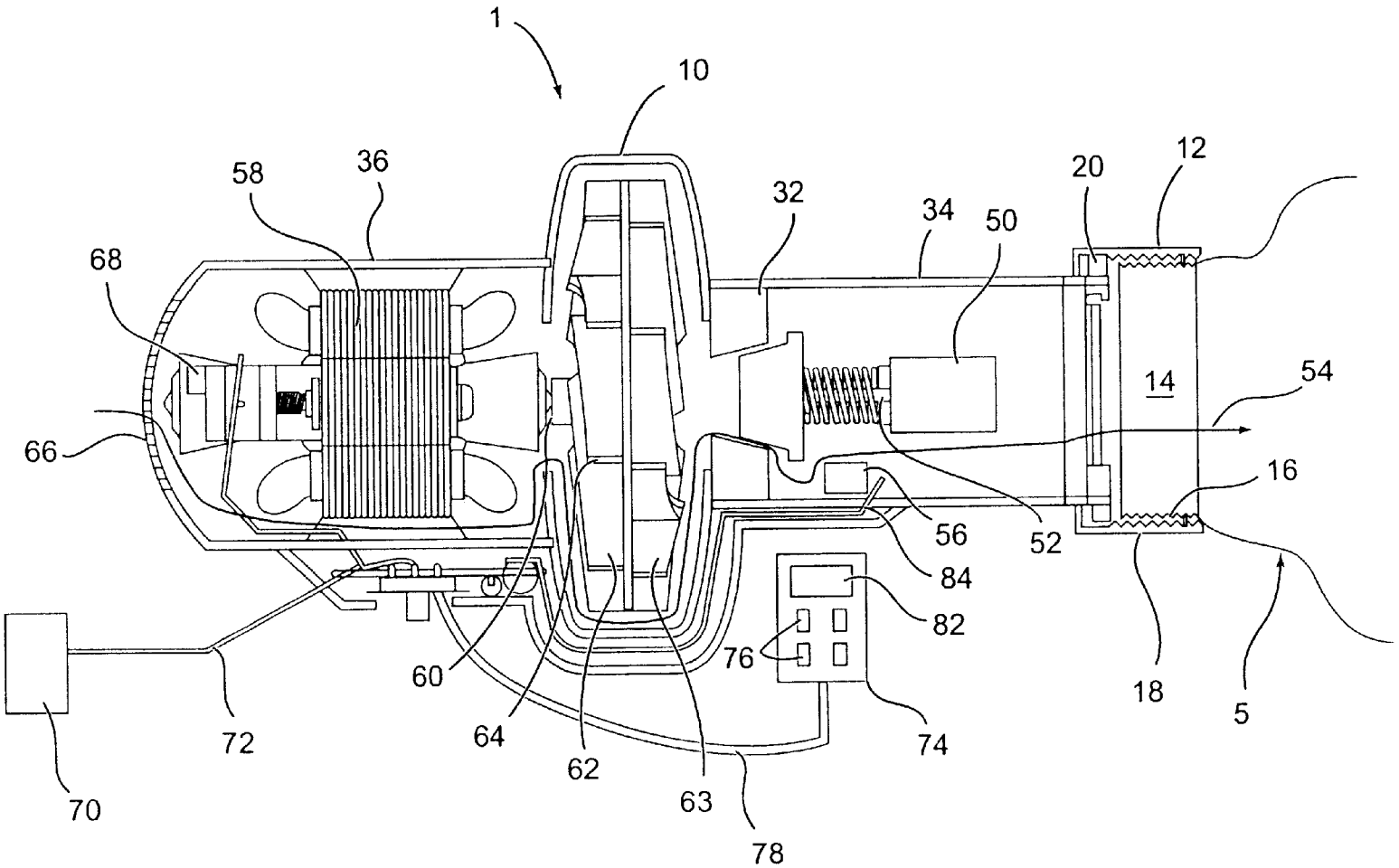

Referring to the accompanying drawings in which like reference numbers indicate like elements, FIGS. 1(*a*) and 1(*b*) illustrate the inflation/deflation device 1 with a portion of the exterior removed to show the components and the interrelationships of these components. A housing 10 encloses the device 1 and transitions to a coupling device 12. The housing 10 can be any suitable material but in the preferred embodiment is plastic. The device attaches to an air mattress 5 at an orifice 14 in order to inflate or deflate the air mattress 5. The air mattress 5 could also be referred to as an inflatable bladder. In the preferred embodiment the orifice 14 has threads 16 located outside the orifice 14. A threaded collar 18 is sized to mate with the threads 16. An o-ring 20 is compressed as the threaded collar 18 is screwed onto the threads 16 providing a fluid tight seal.

Figure 2:
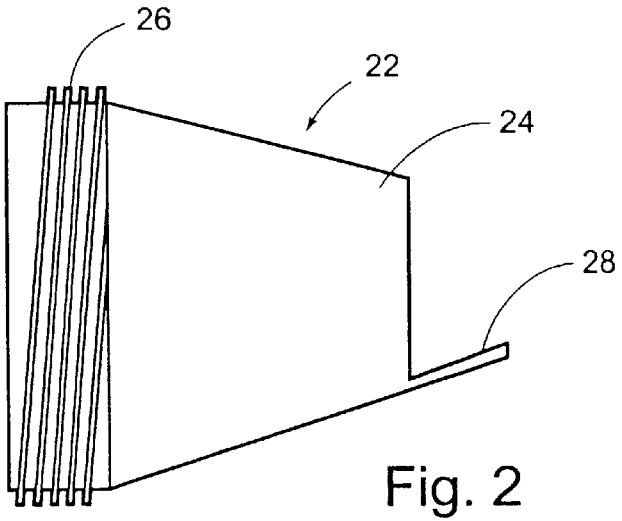
FIG. 2 illustrates a connector for use with the device.
Figure 3:
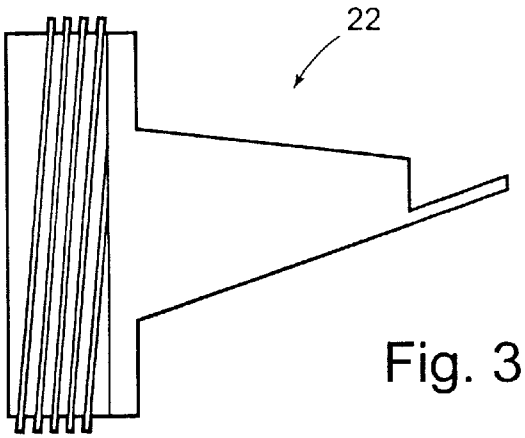
FIG. 3 illustrates an additional connector for use with the device.
Figure 4:
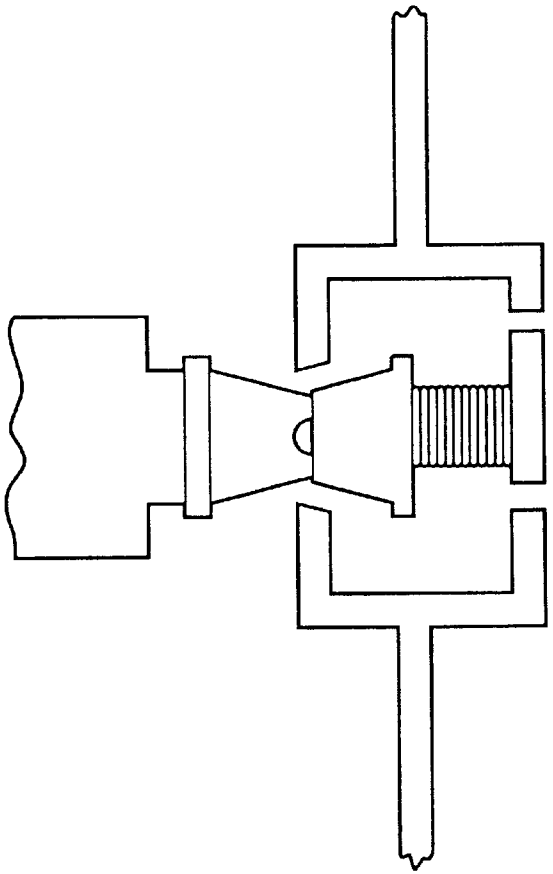
FIG. 4 illustrates an additional connector used with a valved mattress.

The device 1 can also be used with an air mattress 5 having a different type of orifice 14. For example, the air mattress 5 can have an orifice 14 which is not threaded. In an alternative embodiment, an adapter 22 (shown in FIGS. 2 and 3) is provided which has a hollow truncated cone 24 opposite a threaded portion 26. The truncated cone 24 can be of different sizes as needed and is made of a slightly resilient material in order to create a fluid seal when pushed into an orifice 14. The truncated cone 24 terminates in an opener 28. In the preferred embodiment, the opener 28 is an extension of a portion of the truncated cone 24. Opener 28 could also be configured as the opener having semi-circular cutouts in the truncated cone as shown in my U.S. Ser. No. 09/909,794 patent application which has been incorporated by reference and is shown in FIG. 4. In addition to the threaded portion 26 of the adapter 22, any other suitable attachment mechanism could be utilized. The adapter 22 could be configured with (FIGS. 2 and 3) or without (FIG. 4) an opener 28.

Figure 5:
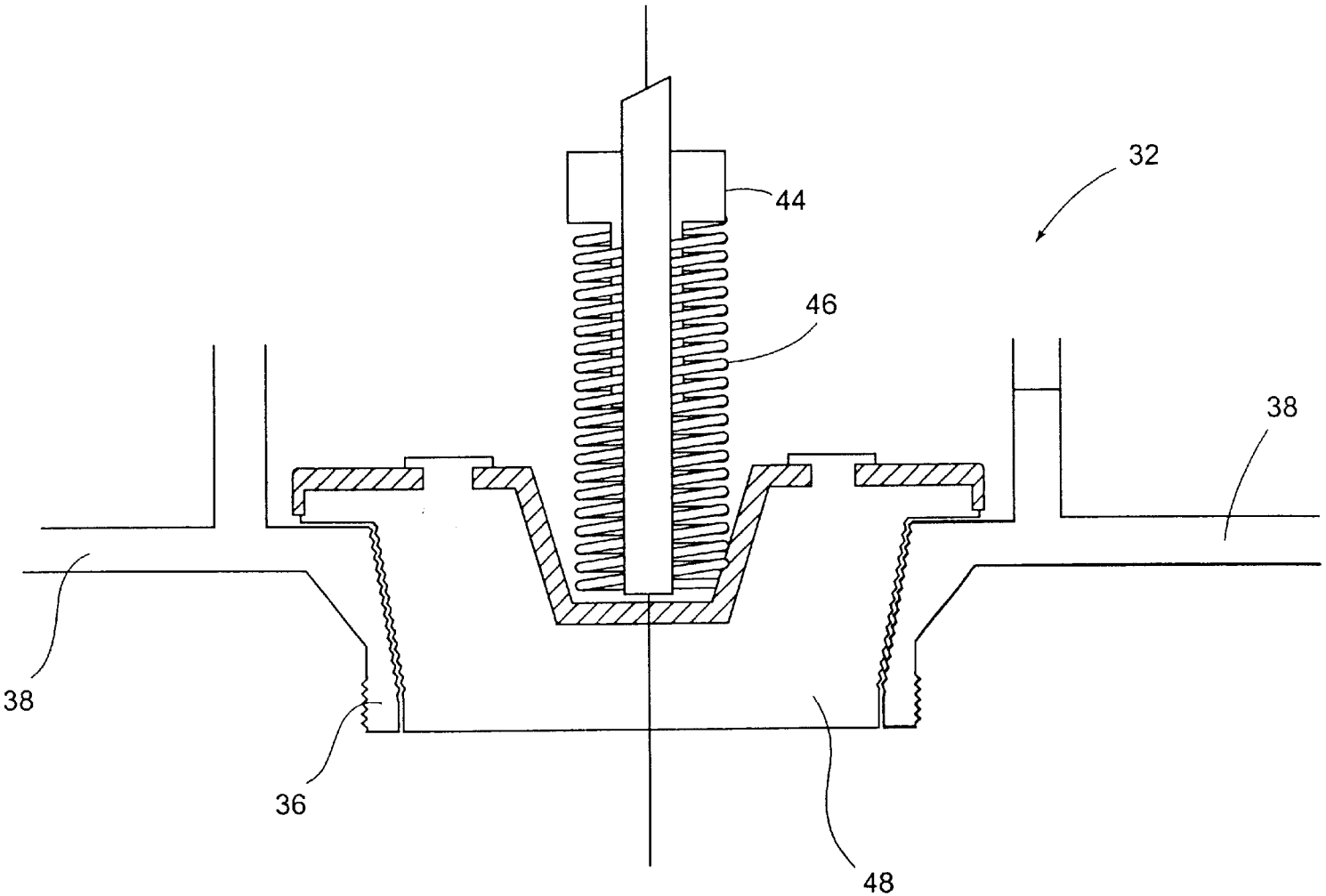
FIG. 5 illustrates a blow up of the two-way valve.

Returning to FIGS. 1(*a*) and 1(*b*), housing 10 extends away from coupling device 12. In the preferred embodiment, a two-way valve 32 is located in the housing 10 and divides the housing into a coupling side 34 adjacent the coupling device 12 and a vent side 36. The two-way valve 32 creates a seal between the coupling side 34 and the vent side 36. Looking to FIG. 5 it can be seen that the two-way valve 32 comprises a valve seat 35 which has a partition 38 extending towards and integrally molded into the housing 10 (not shown in FIG. 5). A spring seat 44 and a spring 46 are provided. Spring 46 abuts a volcano plug 48 biasing the volcano plug 48 to a closed position in which the volcano plug 48 abuts the valve seat 35. When two-way valve 32 is opened fluid can flow past the volcano plug 48. Other types of valves may also be used in the device, such as a diaphragm valve, a ball valve, a gate valve, a hinged valve, a general valve, a butterfly valve etc., none of which are shown in the drawings.

Returning to FIGS. 1(*a*) and 1(*b*), located adjacent to the two-way valve 32 is a solenoid 50. Solenoid 50 has an actuator 52 which is moved by the solenoid 50. When solenoid 50 is in a first state it is de-energized and the actuator 52 is extended from the solenoid 50. When the solenoid 50 is in a second state it is energized to retract the actuator 52 and open the valve. When the solenoid 50 is de-energized and placed in the first state the spring 46 pushes the volcano plug 48 towards valve seat 35 closing the two-way valve 32. The result is a two-way valve 32 which is "spring loaded" towards a closed position. The solenoid could also be located on the opposite side of the valve and be used to push the valve open rather than pull the valve open (not shown).

Attached to the housing 10 on the coupling side 34 of the device 1 is a pressure transducer 56. Pressure transducer 56 can accurately measure the pressure inside the air mattress 5 when the two-way valve 32 is closed and the device 1 is attached to the air mattress 5 with a fluid tight seal.

In the preferred embodiment a motor 58 is located inside the housing 10 on the vent side 36. Of course the motor 58 could be located anywhere inside the housing 10 (i.e. either side of the two way valve 32). Motor 58 is reversible wherein the output can be reversed. A drive shaft 60 is rotated by the motor 58. Attached to the drive shaft 60 are an inbound impeller 62 and outbound impeller 63. Inbound impeller 62 has blades 64 arranged such that fluid is forced away from the motor 58 when rotated. When the motor 58 is driven in a first direction fluid is forced towards the coupling device 12 by the inbound impeller 62. When the motor 58 is reversed the outbound impeller 63 is engaged and fluid is driven away from the coupling device 12. A vent 66 is located in the housing 10 on the vent side 36. A thermal shut-off switch 68 is located adjacent the motor 58.

A power source 70 is provided for the device 1. In the preferred embodiment, the power source 70 is AC delivered by a power cord 72. Power cord 72 could also be used to deliver DC current. An alternative embodiment of the device 1 uses batteries as the power source 70. Both disposable and rechargeable batteries could be used.

A controller 74 is used to operate the device 1. Controller 74 has a selector 76 to allow a user to choose from four options: Inflate position, Deflate position, Valve Open position, and Off position. In the Inflate position the controller 74 controls both the motor 58 and the solenoid 50 such that power is supplied to the motor 58 causing the drive shaft 60 and the impeller 62 to rotate and force fluid towards said two-way valve 32. Simultaneously, the controller 74 delivers power to the solenoid 50 such that the two-way valve 32 is opened and fluid has an unobstructed pathway 54 from the vent 66 through the impeller 62 through the two-way valve 32 and finally through the coupling device 12 and into the air mattress 5. In the deflate position of the controller 74, the solenoid 50 again is energized to open the two-way valve 32 and the motor 58 is reversed and the impeller 62 is rotated in an opposite direction. The result being that the air mattress 5 is deflated as air is pulled from the air mattress 5 by the impeller 62 past the two-way valve 32 and out vent 66. In the Valve Open position, the controller 74 causes the solenoid 50 to energize and open the valve, allowing air to escape. This allows minor adjustments in the firmness of the air mattress 5 when activating the Deflate position would cause too much air to escape. In the off position the controller 74 does not deliver power to the solenoid 50 nor to the motor 58. As a result the two-way valve 32 remains closed and fluid neither enters nor leaves the air mattress 5.

The controller 74 is designed to be tethered to the device 1 by a cord 78. This allows the controller 74 to remain in close proximity to both the air mattress 5 and the device 1. The controller can be part of the housing 10 or it can be a remote control (without cord 78 the controller becomes remote). The remote control can control the device using radio frequency or infra-red signals.

The thermal shut-off switch 68 is connected to the controller such that the controller 74 automatically reverts to the "off position" when a predetermined temperature is sensed. Similarly, a pressure shut-off switch 84 is connected to the pressure transducer 56 and the controller 74. At pressures sensed by the pressure transducer 56 above a predetermined pressure, the pressure shut-off switch 84 causes the controller 74 to be placed in an "off position".

A display 82 can be provided to the device 1. The display 82 can be located on the controller 74 (FIGS. 1(*a*) and 1(*b*)) or on the housing 10. The display 82 utilizes LED or LCD indicators. The display 82 can be used to indicate the pressure inside the air mattress 5 measured by the pressure transducer 56. The display 82 can also display the position of the selector 76 of the controller 74. Any other desired value such as the time can be displayed by the display 82.

Figure 6:
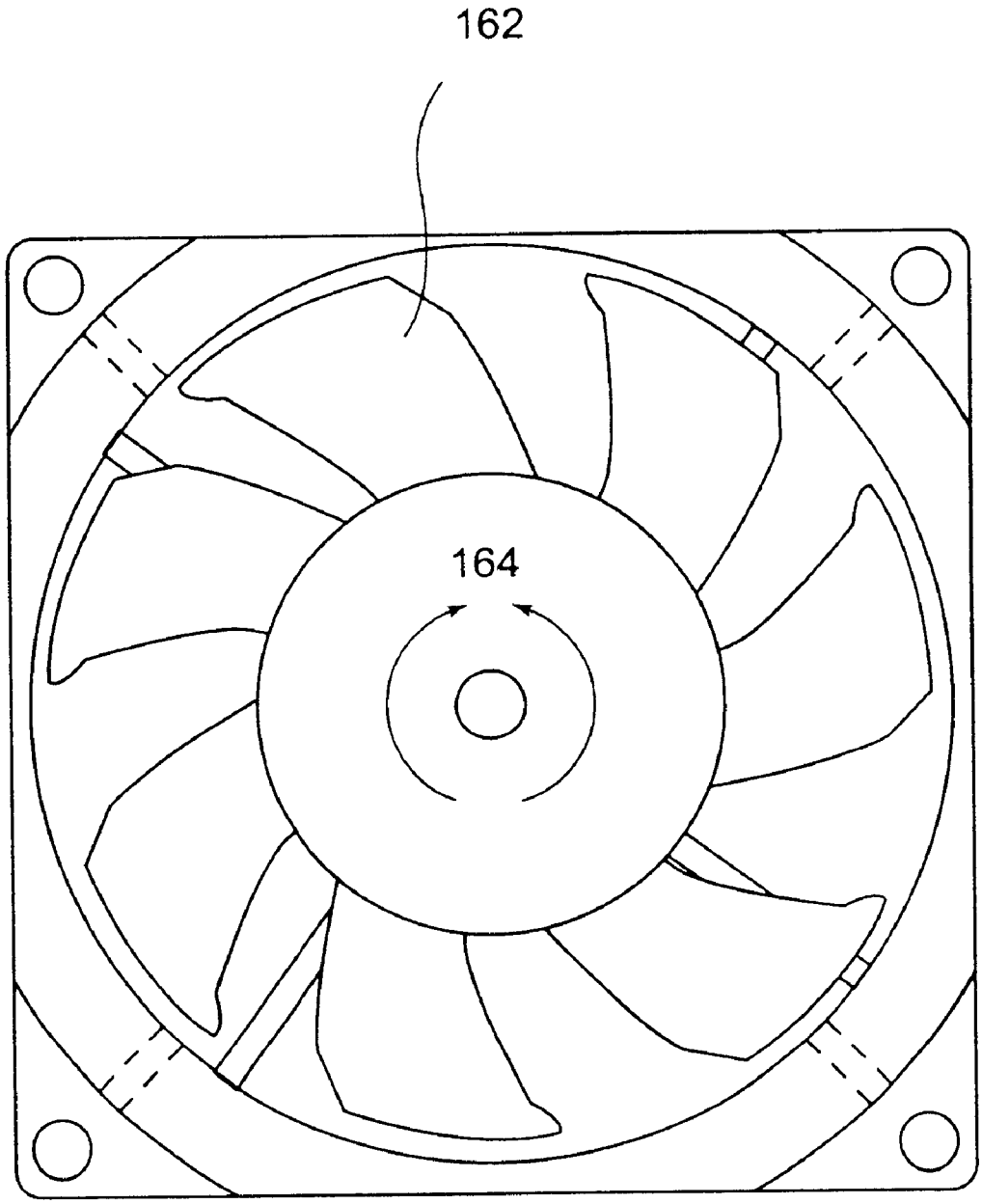
FIG. 6 illustrates an alternative embodiment of the impeller used in the invention.

An alternative embodiment of the invention is shown in FIG. 6. In this embodiment a single impeller 162 is used. Impeller 162 is constructed such that fluid is impelled in a direction of a right hand moment 164 to the rotation of the drive shaft 60. In other words, impeller 162 is a reversible impeller. When the motor is operated in the inflate position fluid is forced towards the coupling device 12. In the deflate position the controller 74 causes motor 58 to turn the drive shaft 60 in an opposite direction and impeller 162 forces fluid away from said coupling device 12.

In use the device 1 is attached to an air mattress 5. The selector 76 of the controller 74 is switched to the "inflate position". This sends power to both the motor 58 and the solenoid 50. The solenoid 50 is energized and the two-way valve 32 is opened. The motor 58 is activated and the drive shaft 60 is rotated such that impeller 62 forces fluid from the vent 66, through two-way valve 32, through the coupling device 12 and into air mattress 5. After the air mattress 5 is sufficiently filled the selector 76 of the controller 74 is returned to the "off position" and the solenoid 50 de-energizes and the two-way valve 32 closes by the combined force of the spring 46 and the air pressure on a back face of the valve. The motor 58 also stops running. To deflate the air mattress 5, the reverse process is employed. The display 82 indicates to a user the pressure in the air mattress 5. The air mattress 5 can be firmed or softened by using the device to inflate or deflated the air mattress 5. Minor adjustments can be made by engaging the Valve open position to energize the solenoid 50 and opening the two-way valve 32.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the solenoid could be located on the same side of the two-way valve as the motor. Thus, the breadth and scope of the present invention should not be limited by any of the above-described exemplary embodiments, but should be defined only in accordance with the following claims appended hereto and their equivalents.

What is claimed is:

1. An inflation/deflation device for use with an inflatable bladder having an inlet, the inflation/deflation device comprising:

a housing defining a coupling device and a vent, the coupling device located on a coupling side of the housing and extending from the housing and being adapted to couple the inflation/deflation device to the inlet in a fluid tight manner, the vent located in a vent side of the housing away from the coupling device and being adapted to vent the inflation/deflation device;

a reversible motor contained within the housing, the motor being adapted to operate in a primary direction, to operate in a second opposite direction, and to not operate;

an impeller attached to the reversible motor, the impeller being adapted to move air through the housing from the vent through the coupling device when the reversible motor operates in the primary direction, the impeller being further adapted to move air through the housing from the coupling device through the vent when the reversible motor operates in the second opposite direction;

a valve having a volcano plug, a valve seat, a spring seat and a spring, the valve contained within the housing and located between the vent and the coupling device, the volcano plug and the valve seat being adapted to form a seal between the vent side of the housing and the coupling side of the housing as the volcano plug engages the valve seat, the spring being adapted to place the plug in engagement with the valve seat;

a solenoid operatively connected to the valve, the solenoid being attached to the housing and being adapted to change from a first state in which the volcano plug is in engagement with the valve seat to a second state in which the volcano plug is not in engagement with the valve seat; and a controller having an off position, an inflate position, a valve open position, and a deflate position, the controller being adapted to control the motor and the solenoid such that; when in the off position the motor does not operate and the solenoid is in the first state, when in the inflate position the motor operates in the primary direction and the solenoid is in the second state, when in the valve open position the motor does not operate and the solenoid is in the second state, and when in the deflate position the motor operates in the second opposite direction and the solenoid is in the second state.

2. The inflation/deflation device of claim 1 further comprising an o-ring located in said coupling device to provide a fluid seal between said inflation/deflation device and the air mattress.

3. The inflation/deflation device of claim 1 wherein said coupling device further comprises a set of threads for screwing said inflation/deflation device onto the air mattress.

4. The inflation/deflation device of claim 1 wherein said coupling device further comprises a plurality of connectors for attaching to different types of air mattresses.

5. The inflation/deflation device of claim 1 further comprising a display.

6. The inflation/deflation device of claim 1 further comprising a pressure transducer located in said coupling side of said housing.

7. The inflation/deflation device of claim 6 further comprising a pressure shut-off switch wherein said motor is deactivated by said pressure shut-off switch at a pressure above a threshold pressure.

8. The inflation/deflation device of claim 1 further comprising a thermal shut-off switch wherein said motor is deactivated at a temperature above a threshold temperature.

9. An inflation/deflation device for use with an inflatable bladder having an inlet, the inflation/deflation device comprising:

a housing defining a coupling device and a vent, the coupling device located on a coupling side of the housing and extending from the housing and being adapted to couple the inflation/deflation device to the inlet in a fluid tight manner, the vent located in a vent side of the housing away from the coupling device and being adapted to vent the inflation/deflation device;

a reversible motor contained within the housing, the motor being adapted to operate in a primary direction, to operate in a second opposite direction, and to not operate;

an impeller attached to the reversible motor, the impeller including an inbound impeller and an outbound impeller, the inbound impeller being adapted to move air through the housing from the vent through the coupling device when the reversible motor operates in the primary direction, the outbound impeller being adapted to move air through the housing from the coupling device through the vent when the reversible motor operates in the second opposite direction;

a valve having a volcano plug, a valve seat, a spring seat and a spring, the valve contained within the housing and located between the vent and the coupling device, the plug and the valve seat being adapted to form a seal between the vent side of the housing and the coupling side of the housing as the volcano plug engages the valve seat, the spring being adapted to place the volcano plug in engagement with the valve seat;

a solenoid operatively connected to the valve, the solenoid being attached to the housing and being adapted to chance from a first state in which the volcano plug is in engagement with the valve seat to a second state in which the volcano plug is not in engagement with the valve seat; and a controller having an off position, an inflate position, a valve open position, and a deflate position, the controller being adapted to control the motor and the solenoid such that: when in the off position the motor does not operate and the solenoid is in the first state, when in the inflate position the motor operates in the primary direction and the solenoid is in the second state, when in the valve open position the motor does not operate and the solenoid is in the second state, and when in the deflate position the motor operates in the second opposite direction and the solenoid is in the second state.

10. The inflation/deflation device of claim 9 further comprising an o-ring located in said coupling device to provide a fluid seal between said inflation/deflation device and the inflatable bladder.

11. The inflation/deflation device of claim 9 wherein said coupling device further comprises a set of threads for screwing said inflation/deflation device onto the inflatable bladder.

12. The inflation/deflation device of claim 9 wherein said coupling device further comprises a plurality of connectors for attaching to different types of inflatable bladders.

13. The inflation/deflation device of claim 9 wherein said controller is a remote control.

14. The inflation/deflation device of claim 9 further comprising a display.

15. The inflation/deflation device of claim 9 further comprising a pressure transducer located in said coupling side of said housing.

16. The inflation/deflation device of claim 15 further comprising a pressure shut-off switch wherein said motor is deactivated by said pressure shut-off switch at a pressure above a threshold pressure.

17. The inflation/deflation device of claim 9 further comprising a thermal shut-off switch wherein said motor is deactivated at a temperature above a threshold temperature.

18. An inflation/deflation device for use with an inflatable bladder having an inlet, the inflation/deflation device comprising:

a housing defining a coupling device and a vent, the coupling device located on a coupling side of the housing and extending from the housing and being adapted to couple the inflation/deflation device to the inlet in a fluid tight manner, the vent located in a vent side of the housing away from the coupling device and being adapted to vent the inflation/deflation device;

a reversible motor contained within the housing, the motor being adapted to operate in a primary direction, to operate in a second opposite direction, and to not operate;

an impeller attached to the reversible motor, the impeller being adapted to move air through the housing from the vent through the coupling device when the reversible motor operates in the primary direction, the impeller being further adapted to move air through the housing from the coupling device through the vent when the reversible motor operates in the second opposite direction;

a valve having a plug, a valve seat, a spring seat and a spring, the valve contained within the housing and located between the vent and the coupling device, the plug and the valve seat being adapted to form a seal between the vent side of the housing and the coupling side of the housing as the plug engages the valve seat, the spring being adapted to place the plug in engagement with the valve seat;

a solenoid operatively connected to the valve, the solenoid being attached to the housing and being adapted to change from a first state in which the plug is in engagement with the valve seat to a second state in which the plug is not in engagement with the valve seat; and a controller having an off position, an inflate position, a valve open position, and a deflate position, the controller being adapted to control the motor and the solenoid such that: when in the off position the motor does not operate and the solenoid is in the first state, when in the inflate position the motor operates in the primary direction and the solenoid is in the second state, when in the valve open position the motor does not operate and the solenoid is in the second state, and when in the deflate position the motor operates in the second opposite direction and the solenoid is in the second state.

19. The inflation/deflation device as set forth in claim 18 further comprising an o-ring located in the coupling device, the o-ring being adapted to provide a fluid tight coupling between the inflation/deflation device and the inlet.

20. The inflation/deflation device as set forth in claim 18 wherein the coupling device includes a set of threads, the set of threads being adapted to interact with another set of threads on the inlet.

21. The inflation/deflation device as set forth in claim 18 further comprising a display.

22. The inflation/deflation device as set forth in claim 18 further comprising a pressure transducer located in the coupling side of the housing, the pressure transducer being adapted to measure the pressure of the inflatable bladder when the inflation/deflation device is attached to the inflatable bladder in a fluid tight manner.

23. The inflation/deflation device as set forth in claim 22 further comprising a pressure shut-off switch operatively connected to the pressure transducer and the controller, the pressure shut-off switch being adapted to place the controller in the off position at a pressure above a threshold pressure.

24. The inflation/deflation device as set forth in claim 18 further comprising a thermal shut-off switch located adjacent the motor, the thermal shut-off switch being adapted to place the controller in the off position at a temperature above a threshold temperature.

25. The inflation/deflation device as set forth in claim 18 wherein the coupling device includes an opener extending from a periphery of the coupling device, the opener being adapted to engage and open the inlet of inflatable bladder.

* * * * *